US009622629B1

(12) United States Patent
Brittain

(10) Patent No.: US 9,622,629 B1
(45) Date of Patent: Apr. 18, 2017

(54) SELF-CLEANING AND RETRACTABLE TOILET BRUSH

(71) Applicant: Timothy Sean Brittain, New York, NY (US)

(72) Inventor: Timothy Sean Brittain, New York, NY (US)

( * ) Notice: Subject to any disclaimer, the term of this patent is extended or adjusted under 35 U.S.C. 154(b) by 0 days.

(21) Appl. No.: 15/294,280

(22) Filed: Oct. 14, 2016

Related U.S. Application Data

(60) Provisional application No. 62/253,166, filed on Nov. 10, 2015, provisional application No. 62/359,085, filed on Jul. 6, 2016.

(51) Int. Cl.

| | |
|---|---|
| ***A47K 11/10*** | (2006.01) |
| ***A46B 15/00*** | (2006.01) |
| ***A46B 17/06*** | (2006.01) |
| ***A46B 9/02*** | (2006.01) |
| ***A46D 1/00*** | (2006.01) |
| ***A47K 17/00*** | (2006.01) |
| ***A46B 5/00*** | (2006.01) |

(52) U.S. Cl.
CPC ..... *A47K 11/10* (2013.01); *A46B 5/0095* (2013.01); *A46B 9/026* (2013.01); *A46B 15/0034* (2013.01); *A46B 15/0095* (2013.01); *A46B 17/065* (2013.01); *A46D 1/006* (2013.01); *A47K 17/00* (2013.01)

(58) Field of Classification Search
CPC ..... A46B 15/0034; A46B 15/0095; A46B 17/065; A47K 11/10
See application file for complete search history.

(56) References Cited

U.S. PATENT DOCUMENTS

| | | | | |
|---|---|---|---|---|
| 8,168,963 | B2 * | 5/2012 | Ratcliffe | A61L 2/10 15/105 |
| 2008/0060829 | A1 * | 3/2008 | Jansheski | A46B 15/0034 174/47 |
| 2010/0306937 | A1 * | 12/2010 | Konishi | A47K 11/10 15/104.93 |
| 2011/0247656 | A1 * | 10/2011 | Ryan | A46B 15/0095 134/18 |

* cited by examiner

*Primary Examiner* — Randall Chin

(57) ABSTRACT

A toilet brush that is self-cleaning and retractable for hygienic storage. The toilet brush includes a handle, a connecting shaft, a tubular enclosure, a removable brush, a plurality of ultraviolet (UV) light sources, and a battery. The handle is terminally connected to the connecting shaft to provide a user with a grasping element. The removable brush is adjacently and concentrically to the connected shaft, opposite the handle. The tubular enclosure houses the removable brush and is positioned concentric with the connecting shaft, adjacent to the removable brush. Additionally, the tubular enclosure is slidably mounted to the connected shat, opposite the handle. The plurality of UV light sources kills or inactivates microorganisms on the removable brush. As such, the plurality of UV light sources is distributed about an inner surface of the tubular enclosure and is powered by the battery. The battery is internally mounted within the connecting shaft.

15 Claims, 7 Drawing Sheets

SELF-CLEANING AND RETRACTABLE TOILET BRUSH

FIELD OF THE INVENTION

The present invention relates generally to bathroom accessories. More specifically, the present invention is a retractable toilet brush having a replaceable brush head. The present invention reduces the amount of space taken up by traditional toilet brushes, keeps the surrounding area clean and dry, and allows the user to conveniently clean and replace the toilet brush. Additionally, the present invention includes an integrated ultraviolet light source in order to inhibit the growth of bacteria on the replaceable brush head

BACKGROUND OF THE INVENTION

Toilet brushes are commonly found in household bathrooms to clean the inside of a toilet bowl. However, existing toilet brushes have a number of downfalls that make them unappealing to use. Traditional toilet brushes come with a holding container for storing the toilet brush when not in use. The holding container takes up large amounts of space within the bathroom, collects bacteria, and is difficult to clean. Furthermore, traditional toilet brushes soak in a great amount of dirty toilet water, causing the bristles to grow mold, potentially contaminating items within its vicinity. The present invention improves upon the aforementioned downfalls of traditional toilet brushes.

The present invention is a retractable toilet brush that does not require a separate holding container for storage and eliminates the potential for contamination. Akin to the function of a retractable pen, the toilet brush retracts into and extend out of the enclosure with a push of a button. In this regard, when the toilet brush is retracted within the enclosure, the user is able to stand the toilet brush upright via the enclosure for storage purposes. Additionally, the bristles of the toilet brush include a hydrophobic and anti-microbial coating that prevent the bristles from absorbing water and growing mold/bacteria. In one embodiment, the present invention includes an integrated ultraviolet light source which inhibits the growth of bacteria within the enclosure and on the replaceable brush.

DETAIL DESCRIPTIONS OF THE INVENTION

All illustrations of the drawings are for the purpose of describing selected versions of the present invention and are not intended to limit the scope of the present invention.

The present invention generally relates to cleaning tools and accessories for the bathroom. In particular, the present invention is an alternative design for a toilet brush that is compact and self-cleaning. Many traditional toilet brushes have bristles that soak in contaminated water after each use, leading to mold growth and general unsanitary conditions. Additionally, traditional toilet brushes are stored in tubular receptacles that, if not regularly cleaned, collect a great amounts of bacteria as contaminated water builds up within the receptacle. Another common problem is that the existing toilet brushes are easily accessible to pets, thus exposing pets to contaminated brush heads. The present invention is a retractable toilet brush that is self-cleaning and does not require a separate holding container. These features prevent mold and bacteria growth, leading to more sanitary conditions within the bathroom.

Figure 1:
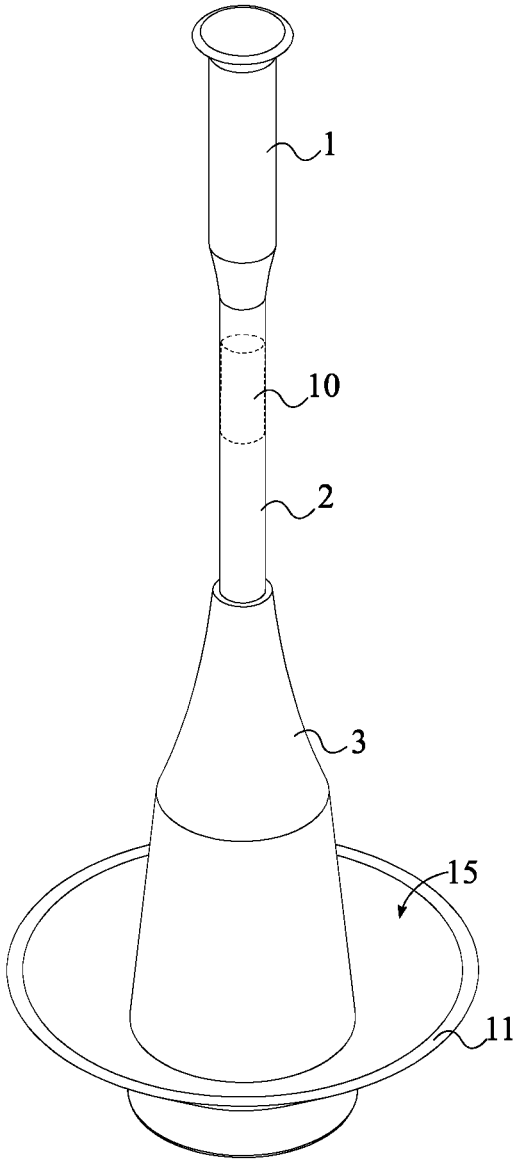
FIG. 1 is perspective view of the present invention configured into a retracted configuration.
Figure 2:
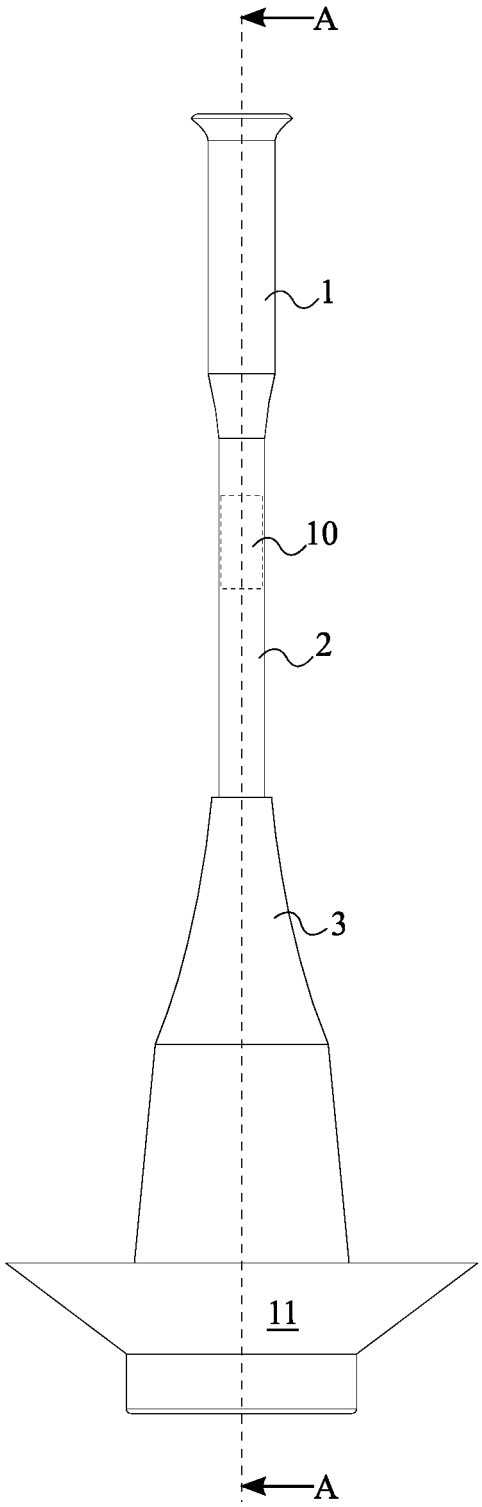
FIG. 2 is a front view of the present invention configured into the retracted configuration.
Figure 3:
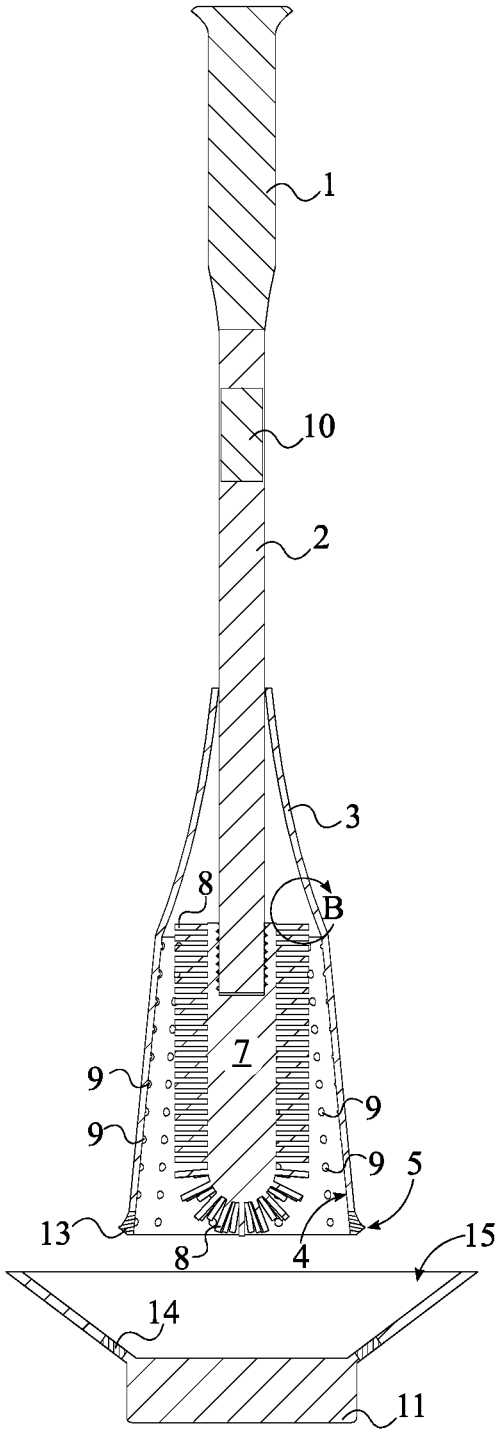
FIG. 3 is a sectional cut view of the present invention taken about line A-A in FIG. 2 without a retracting mechanism.

Referring to FIG. 1 through FIG. 3, the present invention comprises a handle 1, a connecting shaft 2, a tubular enclosure 3, a removable brush 6, a plurality of ultraviolet (UV) light sources 9, and a battery 10. The handle 1 acts as the gripping element and allows a user to easily handle and manipulate the present invention. The handle 1 is terminally connected to the connecting shaft 2. Additionally, the handle 1 is preferably composed of water-resistant rubber material and may contain a multitude of ridges in order to conform to the contours of the human hand. The connecting shaft 2 connects the handle 1 to the removable brush 6 and is preferably an elongated tube that is composed of high quality stainless steel in order to withstand vigorous use. This positions the removable brush 6 at a significant distance from the handle 1 in order to allow the user to safely reach/clean the lower most portions of the toilet bowl. The removable brush 6 provides the scrubbing action in order to engage and subsequently clean contaminated surfaces of the toilet, in particular the inside surfaces of the toilet bowl. The removable brush 6 comprises a central rod 7 and a plurality of bristles 8. The removable brush 6 is attached to the connecting shaft 2 by the central rod 7. More specifically, the central rod 7 is threadly engaged to the connecting shaft 2 in order to allow for easy removal and replacement of the removable brush 6. A male-female threaded connection between the central rod 7 and the connecting shaft 2 ensures a secure attachment while simultaneously allowing for easy removal. Alternative attachment means may be used to attach the central rod 7 to the connecting shaft 2 as well.

Figure 4:
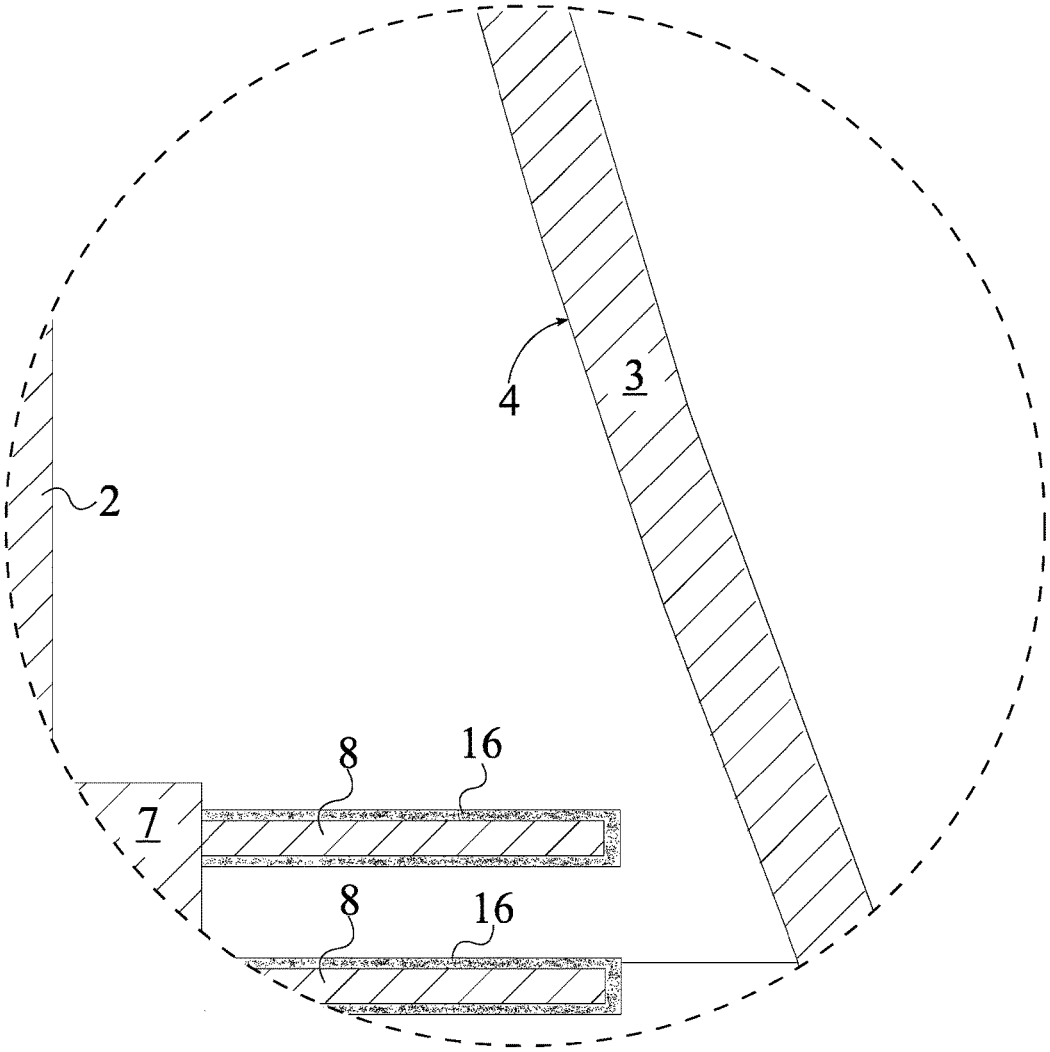
FIG. 4 is a detailed view taken about circle B in FIG. 3.

The plurality of bristles 8 is distributed along the central rod 7 and is the component which directly engages with the contaminated surface in order to physically scrub and dislodge contaminated matter, such as human excrements. The plurality of bristles 8 is radially connected around the central rod 7 to yield an elongated cylindrical shape and increase the surface affected by the present invention. Referring to FIG. 4, the plurality of bristles 8 also prevents and or inhibits the growth of mold and bacteria through a hygienic coating 16, wherein the hygienic coating 16 contains hydrophobic properties and anti-microbial properties. In particular, each of the plurality of bristles 8 is covered by the hygienic coating 16. As a result, the hydrophobic properties keep the removable brush 6 virtually dry upon each use. Additionally, the hydrophobic properties inhibit the growth of microorganisms. Resultantly, the hygienic coating 16 keeps the present invention and the surrounding area germ-free, eliminating any chances of contamination. Therefore, the present invention provides an overall improved device when compared to similar existing inventions.

Figure 5:
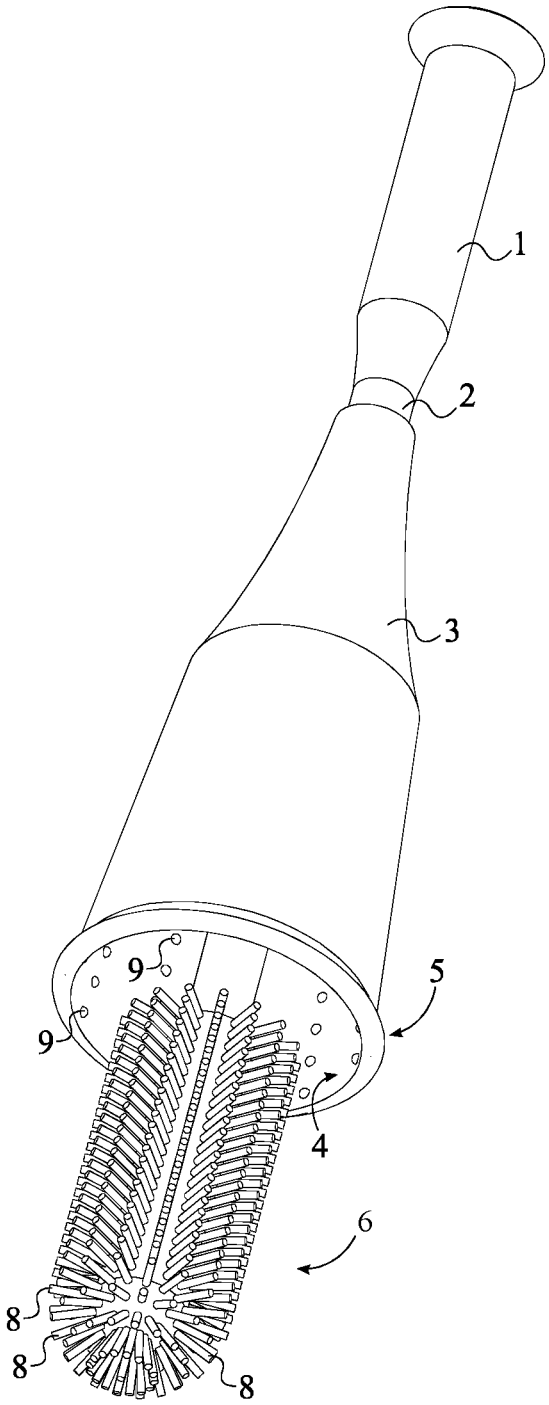
FIG. 5 is a perspective view of the present invention configured into the retracted configuration.

The tubular enclosure 3 protects and houses the removable brush 6 when the present invention is not in use. As a result, there is no need for a bulky receptacle that collects toilet water and germs. In particular, the tubular enclosure 3 is positioned concentric with the connecting shaft 2, adjacent to the removable brush 6, such that the tubular enclosure 3 fully or partially surrounds the removable brush 6. The tubular enclosure 3 is preferably dome-shaped as seen in FIG. 3 in order to reduce the overall profile of the present invention, thus requiring less storage space. In order to achieve the retractable aspect of the present invention, the tubular enclosure 3 is slidably mounted to the interconnected shaft, opposite the handle 1. This connection allows the present invention to be positioned into two states, a retracted configuration and an extended configuration. In the extended configuration, the tubular enclosure 3 is positioned adjacent to the handle 1, exposing the removable brush 6 to the external environment as seen in FIG. 5. In the retracted configuration, the removable brush 6 is positioned within the tubular enclosure 3 as seen in FIG. 2.

Figure 6:
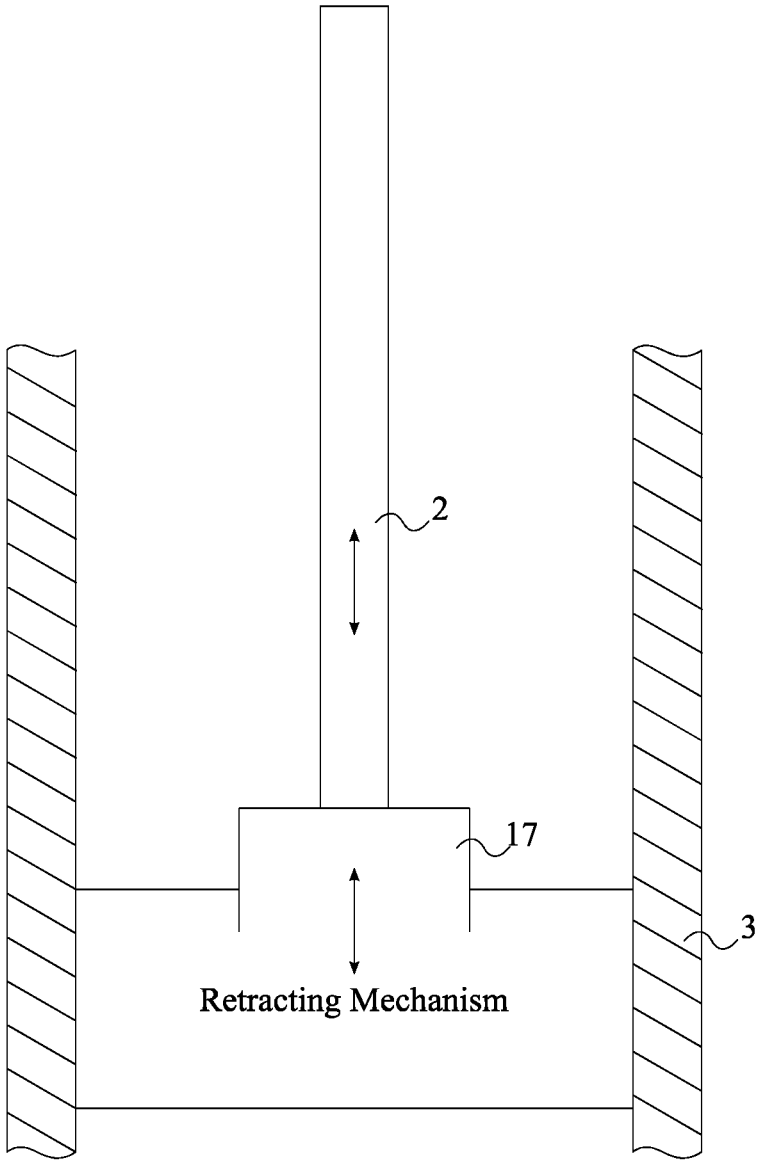
FIG. 6 is a schematic diagram of the present invention depicting a retracting mechanism.

Referring to FIG. 6, the retractable aspect of the present invention is accomplished through a retracting mechanism 17. In particular, the retracting mechanism 17 is mechanically integrated in between the tubular enclosure 3 and the connecting shaft 2. As a result, the tubular enclosure 3 is concentrically and slidably mounted to the connected shaft by the retracting mechanism 17. A variety of mechanisms may be used for the retractable mechanism. In one embodiment of the present invention, a click-and-lock mechanism similar to retractable pens is used as the retracting mechanism 17.

Certain wavelengths of ultraviolet light disrupt cellular functions of microorganisms, thus killing or inactivating said microorganisms. The present invention utilizes this characteristic in order to clean/disinfect the interior of the tubular enclosure 3 and the removable brush 6. This is achieved by the plurality of UV light sources 9. The plurality of UV light sources 9 is distributed about an inner surface 4 of the tubular enclosure 3 with each of the plurality of UV light sources 9 being adjacently connected to the inner surface 4 as seen in FIG. 3. Additionally, each of the plurality of UV light sources 9 is oriented towards an interior of the tubular enclosure 3 and more specifically the removable brush 6. The plurality of UV lights sources kills and/or inactivates residual germs and microorganisms in and around the removable brush 6 after each use of the present invention, thus preventing mold and bacteria from growing on the removable brush 6 and on the inner surface 4 of the tubular enclosure 3. It is preferred that each instance of use of the present invention is followed by the initiation of "clean mode", wherein the plurality of UV light sources 9 is activated and turned on for at least six minutes to adequately disinfect and inhibit the growth of bacteria on the surfaces of the removable brush 6. Although, in alternative embodiments the timing may be altered to meet the preferences and needs of the user.

Figure 7:
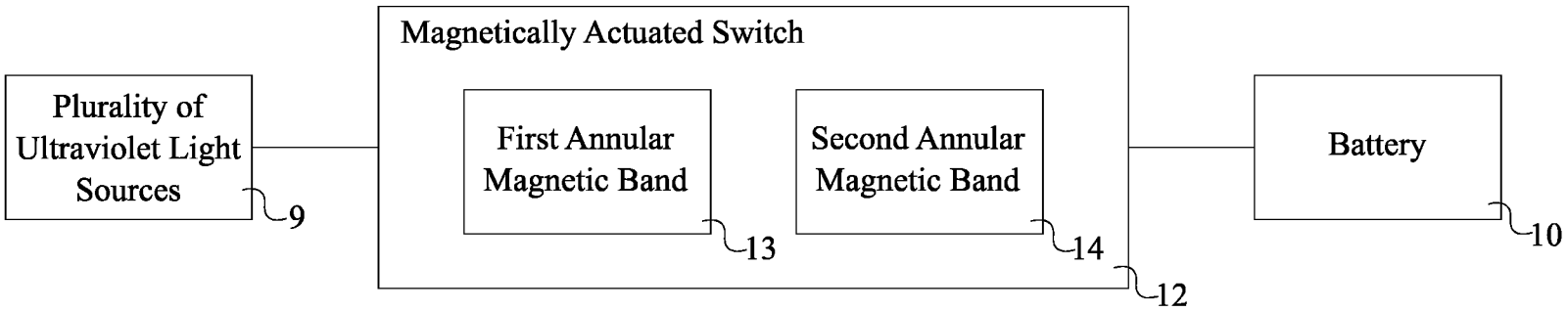
FIG. 7 is an electric schematic of the present invention.

The battery 10 provides the necessary electrical energy for the plurality of UV light sources 9. The battery 10 is internally mounted within the connecting shaft 2. Additionally, the battery 10 is electrically connected to the plurality of UV light sources 9 as seen in FIG. 7. In one embodiment of the present invention, the battery 10 is removably mounted within the connecting shaft 2 in order to allow the user to easy charge the battery 10. A variety of means may be used to turn on the plurality of UV light sources 9 including, but not limited to, an external button, a preprogrammed timer, and other similar mechanisms.

In the preferred embodiment, the means for operating and controlling the plurality of UV light sources 9 includes the use of a cylindrical base 11, an enclosure-receiving cavity 15, and a magnetically actuated switch 12. The cylindrical base 11 is used to support the tubular enclosure 3 and the internal components for storage purposes, preventing any residual contaminated water on the removable brush 6 from spilling onto the floor. In particular, the enclosure-receiving cavity 15 concentrically traverses into the cylindrical base 11 and is shaped/sized to the compliment the tubular enclosure 3. The magnetically actuated switch 12 serves two main purposes, to attach the tubular enclosure 3 to the cylindrical base 11 and to activate the plurality of UV light sources 9. The magnetically actuated switch 12 comprises a first annular magnetic band 13 and a second annular magnetic band 14. Additionally, the magnetically actuated switch 12 is electrically connected between the plurality of UV light sources 9 and the battery 10. The first annular magnetic band 13 is adjacently connected to the cylindrical base 11. Complimentary to the first annular magnetic band 13, the second annular magnetic band 14 is concentrically integrated into a rim 5 of the tubular enclosure 3, opposite the handle 1 as seen in FIG. 3. In order to store the present invention on the cylindrical base 11, the rim 5 of the tubular enclosure 3 is concentrically positioned within the enclosure-receiving cavity 15. The tubular enclosure 3 is attached to the cylindrical base 11 by the magnetic attraction between the first annular magnetic band 13 and the second annular magnetic band 14. A variety of mechanisms may be used for the magnetically actuated switch 12 such as a reed switch. When the first annular magnetic band 13 comes into the proximity of the second annular magnetic band 14, electrical energy is supplied to the plurality of UV light sources 9 by the battery 10 for a preset amount of time, thus initiating the "clean mode". In general, the battery 10 is electrically connected to the plurality of UV light sources 9 by the magnetically actuated switch 12.

In alternative embodiments of the present invention, the plurality of UV light sources 9 is controlled through traditional electrical switches. In one embodiment of the present invention, an electric switch is integrated in between the tubular enclosure 3 and the cylindrical base 11 such that when the tubular enclosure 3 is positioned within the cylindrical base 11, an electric circuit is completed which turns on the plurality of UV light sources 9. In another embodiment of the present invention, a pressure sensor is integrated into the rim 5 of the tubular enclosure 3. Resultantly, when the tubular enclosure 3 is placed on the ground or within the cylindrical base 11, the plurality of UV light sources 9 is turned on for the preset amount of time.

In an alternative embodiment of the present invention, the plurality of UV light sources 9 and the battery 10 are integrated into the cylindrical base 11. In particular, the battery 10 is internally mounted within the cylindrical base 11. The plurality of UV light sources 9 is positioned within the enclosure-receiving cavity 15 and adjacently connected to the cylindrical base 11. This embodiment stores the electrical and hygienic aspect of the present invention in the cylindrical base 11 for easy replacement. Similar to the preferred embodiment, when the tubular enclosure 3 is positioned within the enclosure-receiving cavity 15, the first annular magnetic band 13 interacts with the second annular magnetic band 14 in order to turn on the plurality of UV light sources 9. The plurality of UV light sources 9 then illuminates the space within the tubular enclosure 3 and the removable brush 6 with ultraviolet light in order to inhibit the growth of microorganisms. To further ensure that each of the plurality of bristles 8 is illuminated by the ultraviolet let, the inner surface of the tubular capsule is covered with a highly reflective surface.

Although the invention has been explained in relation to its preferred embodiment, it is to be understood that many other possible modifications and variations can be made without departing from the spirit and scope of the invention as hereinafter claimed.

What is claimed is:

1. A self-cleaning and retractable toilet brush comprises:
a handle;
a connecting shaft;
a tubular enclosure;
a removable brush;
a plurality of ultraviolet (UV) light sources;
a battery;
the handle being terminally connected to the connecting shaft;
the removable brush being positioned adjacent to the connecting shaft, opposite the handle;
the removable brush being concentrically attached to the connecting shaft;
the tubular enclosure being positioned concentric with the connecting shaft, adjacent to the removable brush;
the tubular enclosure being slidably mounted to the connecting shaft, opposite the handle;
the battery being internally mounted within the connecting shaft;
the battery being electrically connected to the plurality of UV light sources;
the plurality of UV light sources being distributed about an inner surface of the tubular enclosure; and
each of the plurality of UV light sources being adjacently connected to the inner surface of the tubular enclosure.

2. The self-cleaning and retractable toilet brush as claimed in claim 1 comprises:
the removable brush comprises a central rod and a plurality of bristles;
the central rod being threadly engaged to the connecting shaft;
the plurality of bristles being distributed along the central rod; and
the plurality of bristles being radially connected around the central rod.

3. The self-cleaning and retractable toilet brush as claimed in claim 2, wherein each of the plurality of bristles is covered by a hygienic coating.

4. The self-cleaning and retractable toilet brush as claimed in claim 1 comprises:
a cylindrical base;
an enclosure-receiving cavity;
the enclosure-receiving cavity concentrically traversing into the cylindrical base; and
the rim of the tubular enclosure being concentrically positioned within the enclosure-receiving cavity.

5. The self-cleaning and retractable toilet brush as claimed in claim 4 comprises:
a magnetically actuated switch;
the magnetically actuated switch being electrically connected between the plurality of UV light sources and the battery;
the magnetically actuated switch comprises a first annular magnetic band and a second annular magnetic band;
the first annular magnetic band being concentrically positioned within the enclosure-receiving cavity;
the first annular magnetic band being adjacently connected to the cylindrical base;
the second annular magnetic band being concentrically integrated into a rim of the tubular enclosure, opposite the handle; and
the battery being electrically connected to the plurality of UV light sources by the magnetically actuated switch.

6. The self-cleaning and retractable toilet brush as claimed in claim 1 comprises:
the connecting shaft, the removable brush, and the tubular enclosure being configured into an extended configuration; and
the tubular enclosure being positioned adjacent to the handle.

7. The self-cleaning and retractable toilet brush as claimed in claim 1 comprises:
the connecting shaft, the removable brush, and the tubular enclosure being configured into a retracted configuration; and
the removable brush being positioned within the tubular enclosure.

8. The self-cleaning and retractable toilet brush as claimed in claim 1 comprises:
a retracting mechanism;
the retracting mechanism being mechanically integrated in between the tubular enclosure and the connecting shaft; and
the tubular enclosure being concentrically and slidably mounted to the connecting shaft by the retracting mechanism.

9. A self-cleaning and retractable toilet brush comprises:
a handle;
a connecting shaft;
a tubular enclosure;
a removable brush;
a plurality of ultraviolet (UV) light sources;
a battery;
a retracting mechanism;
the handle being terminally connected to the connecting shaft;
the removable brush being positioned adjacent to the connecting shaft, opposite the handle;
the removable brush being concentrically attached to the connecting shaft;
the tubular enclosure being positioned concentric with the connecting shaft, adjacent to the removable brush;
the tubular enclosure being slidably mounted to the connecting shaft, opposite the handle;
the battery being internally mounted within the connecting shaft;
the battery being electrically connected to the plurality of UV light sources;
the plurality of UV light sources being distributed about an inner surface of the tubular enclosure;
each of the plurality of UV light sources being adjacently connected to the inner surface of the tubular enclosure;
the retracting mechanism being mechanically integrated in between the tubular enclosure and the connecting shaft; and
the tubular enclosure being concentrically and slidably mounted to the connecting shaft by the retracting mechanism.

10. The self-cleaning and retractable toilet brush as claimed in claim 9 comprises:
the removable brush comprises a central rod and a plurality of bristles;
the central rod being threadly engaged to the connecting shaft;
the plurality of bristles being distributed along the central rod; and
the plurality of bristles being radially connected around the central rod.

11. The self-cleaning and retractable toilet brush as claimed in claim 10, wherein each of the plurality of bristles is covered by a hygienic coating.

12. The self-cleaning and retractable toilet brush as claimed in claim 9 comprises:

a cylindrical base;

an enclosure-receiving cavity;

the enclosure-receiving cavity concentrically traversing into the cylindrical base; and the rim of the tubular enclosure being concentrically positioned within the enclosure-receiving cavity.

13. The self-cleaning and retractable toilet brush as claimed in claim 12 comprises:

a magnetically actuated switch;

the magnetically actuated switch being electrically connected between the plurality of UV light sources and the battery;

the magnetically actuated switch comprises a first annular magnetic band and a second annular magnetic band;

the first annular magnetic band being concentrically positioned within the enclosure-receiving cavity;

the first annular magnetic band being adjacently connected to the cylindrical base;

the second annular magnetic band being concentrically integrated into a rim of the tubular enclosure, opposite the handle; and the battery being electrically connected to the plurality of UV light sources by the magnetically actuated switch.

14. The self-cleaning and retractable toilet brush as claimed in claim 9 comprises:

the connecting shaft, the removable brush, and the tubular enclosure being configured into an extended configuration; and the tubular enclosure being positioned adjacent to the handle.

15. The self-cleaning and retractable toilet brush as claimed in claim 9 comprises:

the connecting shaft, the removable brush, and the tubular enclosure being configured into a retracted configuration; and the removable brush being positioned within the tubular enclosure.

* * * * *